United States Patent [19]

Grossar

[11] Patent Number: 4,518,835

[45] Date of Patent: May 21, 1985

[54] FORCE RESPONSIVE SWITCH

[75] Inventor: Francis Grossar, Heers, Belgium

[73] Assignee: General Instrument Corp., Clifton, N.J.

[21] Appl. No.: 525,172

[22] Filed: Aug. 23, 1983

[30] Foreign Application Priority Data

Sep. 1, 1982 [BE] Belgium ..... 0/208929

[51] Int. Cl.[3] ..... H01H 35/02

[52] U.S. Cl. ..... 200/61.45 M; 335/205; 335/207

[58] Field of Search ..... 200/61.45 M, 81.9 M, 200/84 C; 335/205, 207

[56] References Cited

U.S. PATENT DOCUMENTS

| | | | |
|---|---|---|---|
| 3,132,220 | 5/1964 | Uri et al. | 200/61.45 M |
| 3,180,951 | 4/1965 | Preisz | 200/61.45 M |
| 3,376,527 | 4/1968 | Risk | 335/207 |
| 3,813,505 | 5/1974 | Shoji | 200/61.45 M |
| 3,873,957 | 3/1975 | Wurscher et al. | 335/207 X |
| 4,016,535 | 4/1977 | Dinlocker | 200/61.45 M |
| 4,450,326 | 5/1984 | Ledger | 200/61.45 M |

*Primary Examiner*—George Harris

*Attorney, Agent, or Firm*—James & Franklin

[57] ABSTRACT

In response to a deceleration force, a rapidly reacting magnetic system causes a reed switch to change state. A predetermined time after the force ceases, a second, relatively slowly reacting magnetic system causes the switch to return to its original state. Each magnetic system includes a fixed magnet and a magnet movable within a recess. The reed switch is situated in a housing proximate the recesses and is controlled by the positions of the movable magnets. The recess through which the movable magnet of the slowly reacting system moves contains a fluid. This magnet carries a pair of self-positioning members which cooperate with the fluid to regulate the speed of the movement of the magnet within the recess, in accordance with its direction of movement, such that the slowly reacting system maintains the switch in the changed state and, thereafter, returns the switch to its original state.

22 Claims, 5 Drawing Figures

FORCE RESPONSIVE SWITCH

The present invention relates to a force responsive switch and, more particularly, to a magnetically controlled switch which is rapidly caused to change state in response to the application of a force greater than a given magnitude and, thereafter, returned to its original state a predetermined time after the force terminates.

In certain instances, it is necessary to energize or de-energize an electrical circuit in response to the application of a force above a given magnitude. For example, a movable object, such as a vehicle, may contain an electrical circuit designed to control the inflation of an air bag or the like which must be energized in response to the rapid deceleration of the vehicle. Such an electrical circuit must remain energized for a relatively brief period and, thereafter, be de-energized.

In general, it is difficult to design a force sensing system which will operate in this manner which will function reliably under all conditions and, at the same time, be of simple enough construction to be light in weight, small in size and inexpensive. These criteria are met by the present invention which employs two independently operating magnetic switch control systems of relatively simple construction. One of the systems reacts rapidly to the application of the force to change the state of the switch. The other system reacts relatively slowly to return the switch to its original state after the application of the force has ceased More particularly, the present invention employs a magnetically controlled switch, which is operably electrically connected to the circuit to be energized or de-energized upon application of the force. Two independently acting magnetic control systems are situated adjacent the magnetically controlled switch. One of the magnetic control systems reacts relatively rapidly to the application of force and serves to change the state of the magnetically controlled switch almost instantaneously upon the application of a force above the given magnitude. The second magnetic control system reacts relatively slowly to the application of the force and serves to return the switch to its original state a predetermined time interval after the force has ceased.

As will become clear from the following description, the time interval between changes in the state of the magnetically controlled switch can be determined, within limits, by the appropriate selection of materials and the structure design of certain of the parts of the invention. The magnetic control system which reacts relatively slowly to the application of force includes a pair of members which move through a fluid. By selecting a fluid of a particular viscosity and by the appropriate structural design of the members, the amount of time for this magnetic control system to react can be adjusted to suit a particular application.

It is, therefore, a prime object of the present invention to provide a force responsive switch which changes state rapidly after the application of a force above a given magnitude.

It is another object of the present invention to provide a force responsive switch which returns to its original state relatively slowly in reaction to the application of a force above a given magnitude.

It is another object of the present invention to provide a force responsive switch which includes two independently reacting magnetic switch control systems.

It is another object of the present invention to provide a force responsive switch of relatively simple construction which includes simple parts which cooperate together reliably.

In accordance with the present invention, a force responsive switch is provided comprising magnetically operated means switchable between first and second states and first and second magnetic means for controlling the state of the switchable means. The first magnetic control means reacts relatively rapidly to the application of a force above a given magnitude and is adapted to change the state of the switchable means from a first state to a second state. The second magnetic control means reacts relatively slowly to the application of force above a given magnitude and is adapted to change the state of the switchable means from the second state to the first state.

The switch includes a housing with a first recess. The first magnetic control means comprises a magnet fixedly mounted to the housing, proximate one end of the recess. Situated within the first recess is a magnet movable within the recess between a first position, proximate the fixed magnet and a second position remote from the fixed magnet.

Preferably, the switchable means comprises a conventional reed switch. The reed switch is mounted in the housing proximate the first recess.

The housing also has a second recess. The second magnetic control means comprises a second fixed magnet fixedly mounted proximate one end of the second recess. Situated within the second recess is a second magnet movable therein between a first position proximate the second fixed magnet and a second position remote from the second fixed magnet.

Self-adjusting means are associated with the second movable magnet and are adapted to regulate the speed of movement of the second movable magnet by permitting movement in a first direction with minimum resistance and movement in a second direction with maximum resistance.

The second recess is preferably filled with a fluid. The speed regulation means includes mechanical means situated in the fluid for increasing the resistance of the fluid to the movement of the mechanical means, as the second movable magnet moves in one direction, from its second to its first position, as compared to the resistance of the fluid to the movement of the mechanical means, as the second movable magnet moves in the other direction, from its first position to its second position.

The mechanical means includes a member movably mounted to the second movable magnet. The member is movable between a first position, wherein the fluid exerts relatively little resistance to the movement thereof, to a second position, wherein the fluid exerts a relatively large resistance to the movement thereof. Preferably, the mechanical means includes a connecting element mounted to the second movable magnet and first and second movable members. The first and second movable members are pivotally mounted to one end of the connecting element.

Upon the application of sufficient force to overcome the magnetic attraction between the fixed magnets and the movable magnets, respectively, the movable magnets each move to a position within the respective recesses which is remote from the fixed magnets. The first movable magnet, which is situated in a non-sealed recess, reaches the far end of the recess fairly rapidly, actuating a reed switch located proximate thereto within the housing. The second movable magnet, which is situated within the fluid filled recess, moves to its remote position somewhat more slowly, in part due to the effect of the pivotally connected speed regulating members, although the members are in a position of least resistance for movement in this direction.

After the force ceases, the first movable magnet returns relatively rapidly to its original position because of the attraction of the first fixed magnet. However, this does not effect the state of the switch because the second movable magnet functions to maintain the switch in the changed state. The second movable magnet will reverse direction and move back towards its original position because of the attraction of the second fixed magnet. Upon this reversal of direction, the speed regulating members will pivot to positions of maximum resistance, thereby reducing the return speed of the second movable magnet. Upon return to its original position, the second movable magnet will change the state of the reed switch back to its original state. In this manner, the state of the reed switch is changed from its original state relatively rapidly after the application of the force, but is returned to its original state only a predetermined time interval after the force has ceased.

To these and to such other objects which may hereinafter appear, the present invention relates to a force responsive switch, as described in detail in the following specification, and recited in the annexed claims, taken together with the accompanying drawings, wherein like numerals refer to like parts, and in which:

Figure 1:
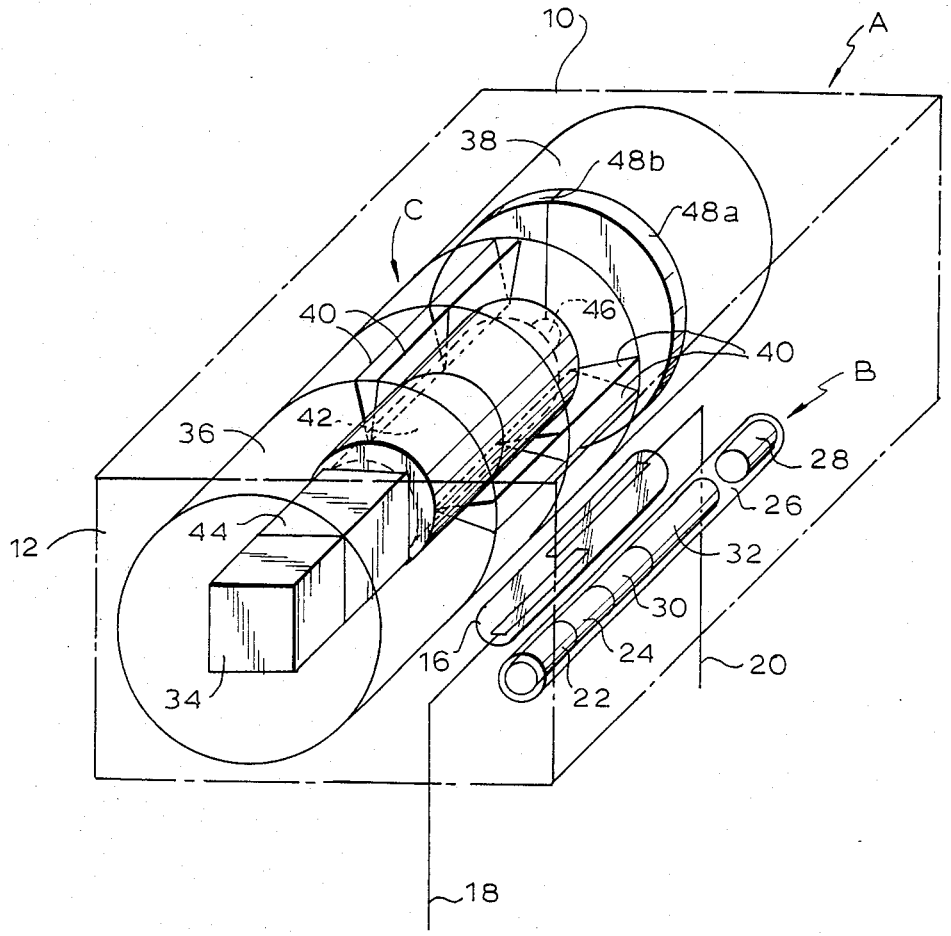
FIG. 1 is a perspective view of the force responsive switch of the present invention.

As illustrated in the drawings, the force responsive switch of the present invention comprises a housing, generally designated A. Housing A has a forward facing end 10 and a rear facing end 12. It is designed to be mounted in a movable object with the forward facing end 10 toward the front of the object and the rear facing end 12 toward the back thereof. Housing A includes an opening or channel 14 within which a magnetically controlled switch, such as a conventional encapsulated reed switch 16, is mounted. Reed switch 16 has leads 18 and 20 to permit same to be electrically connected to the circuit to be either energized or deenergized upon the application of sufficient force to housing A.

Also contained within housing A, proximate reed switch 16, are first and second magnetic control systems, generally designated B and C, respectively. System B is a relatively rapidly reacting magnetic control system and will serve to change the state of reed switch 16 from its original state almost instantaneously upon the application of force above a given magnitude to housing A in a direction parallel to the longitudinal axis of housing A. System C is a relatively slowly reacting magnetic control system and will serve to change the state of reed switch 16 back to its original state a predetermined time after the applied force has ceased.

Housing A is intended to be placed in a movable object, such as a vehicle or the like, with its longitudinal axis parallel to the direction of movement of the object. When positioned in this manner, the magnetic control systems will react to the deceleration of the vehicle when that deceleration results in the application of a force above a given magnitude to housing A.

Magnetic control system B includes a fixed permanent magnet 22 with a non-magnetic isolating part 24 affixed thereto. Magnet 22 and part 24 are affixed to the rearward facing end of a non-sealed cylindrical recess or channel 26, elongated along the longitudinal axis of the housing. Recess 26 is closed at the forward facing end by a non-magnetic stop part 28. Within channel 26, between isolating part 24 and stop part 28, and freely received therein, is a movable unit including a permanent magnet 30 and a non-magnetic mass 32.

The slow reacting magnetic control system C includes a permanent magnet 34 affixed to the interior surface of the rearwardly facing wall of housing A. Magnet 34 is situated with a relatively large sealed cylindrical recess or channel 36 which contains a fluid, preferably a liquid 38. Recess 36 is generally parallel to, but spaced from, recess 26 and is elongated in a direction parallel to recess 26, that is, along the longitudinal axis of the housing. Extending inwardly from the opposite walls of recess 36, near the mid-section thereof, are a plurality of guide members 40 which function to align a second movable unit, including a permanent magnet 42 and a non-magnetic mass 44, with magnet 34 and to guide the movement of the second movable unit along recess 36.

A speed regulating means is connected to the forward facing surface of magnet 42. The speed regulating means includes a connecting element 46 and a pair of semi-circular shaped members **48*a* and 48*b* which are pivotally connected to the forward end of element 46 by any conventional means, such as a pin 50 extending between spaced ends of element 46, which passes through openings in connecting members 52*a*, 52*b* affixed to each member 48*a*, 48*b*, respectively. Members 48*a* and 48*b* change position relative to element 46, due to the resistance of fluid 38, to alter the speed of movement of magnet 42**, depending upon which direction the magnet is moving.

Figure 2:
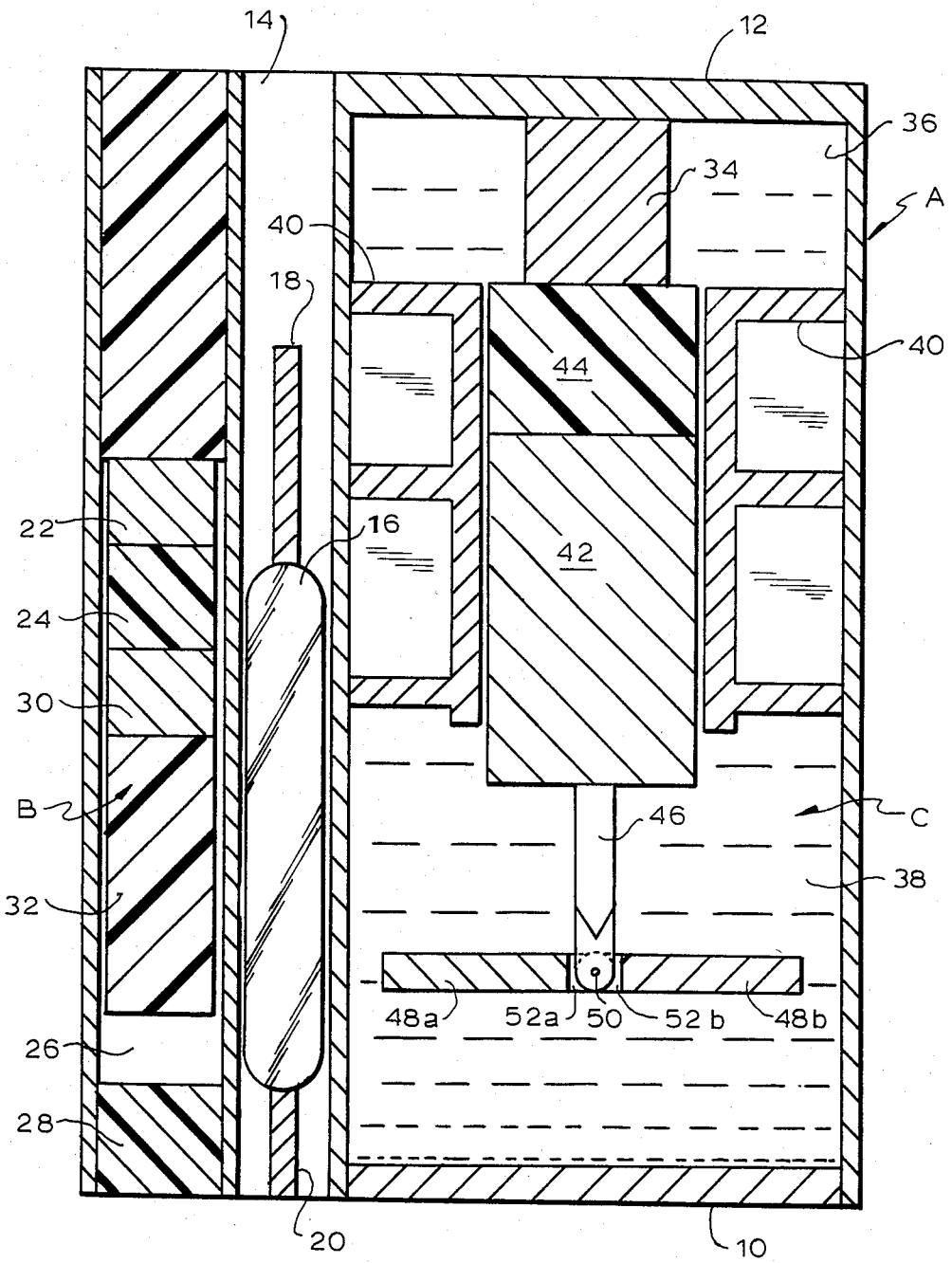
FIG. 2 is a lengthwise sectional view of the switch illustrated in FIG. 1 in the rest condition.
Figure 3:
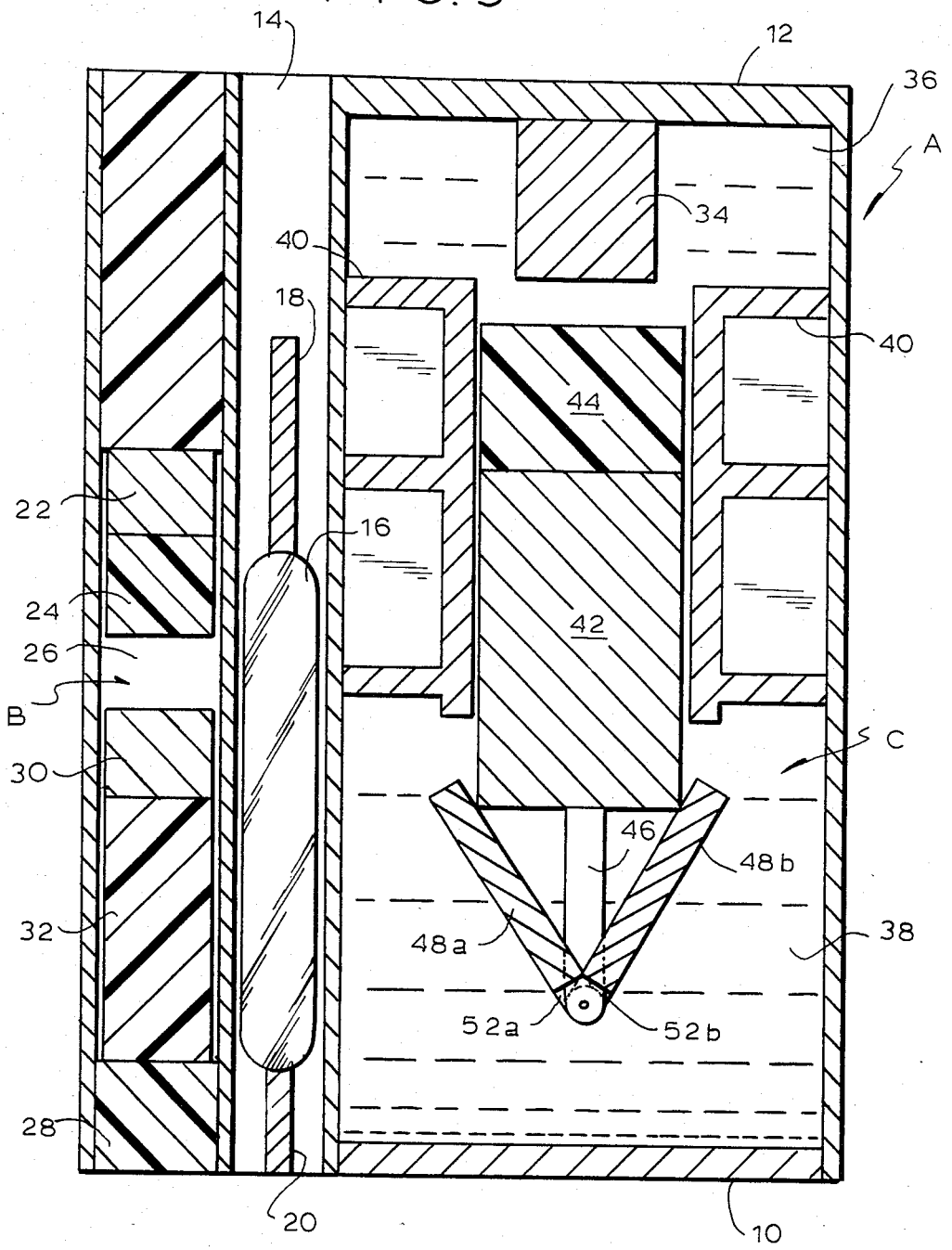
FIGS. 3–5 illustrate successive conditions of the switch illustrated in FIG. 1 during the operation thereof.
Figure 4:
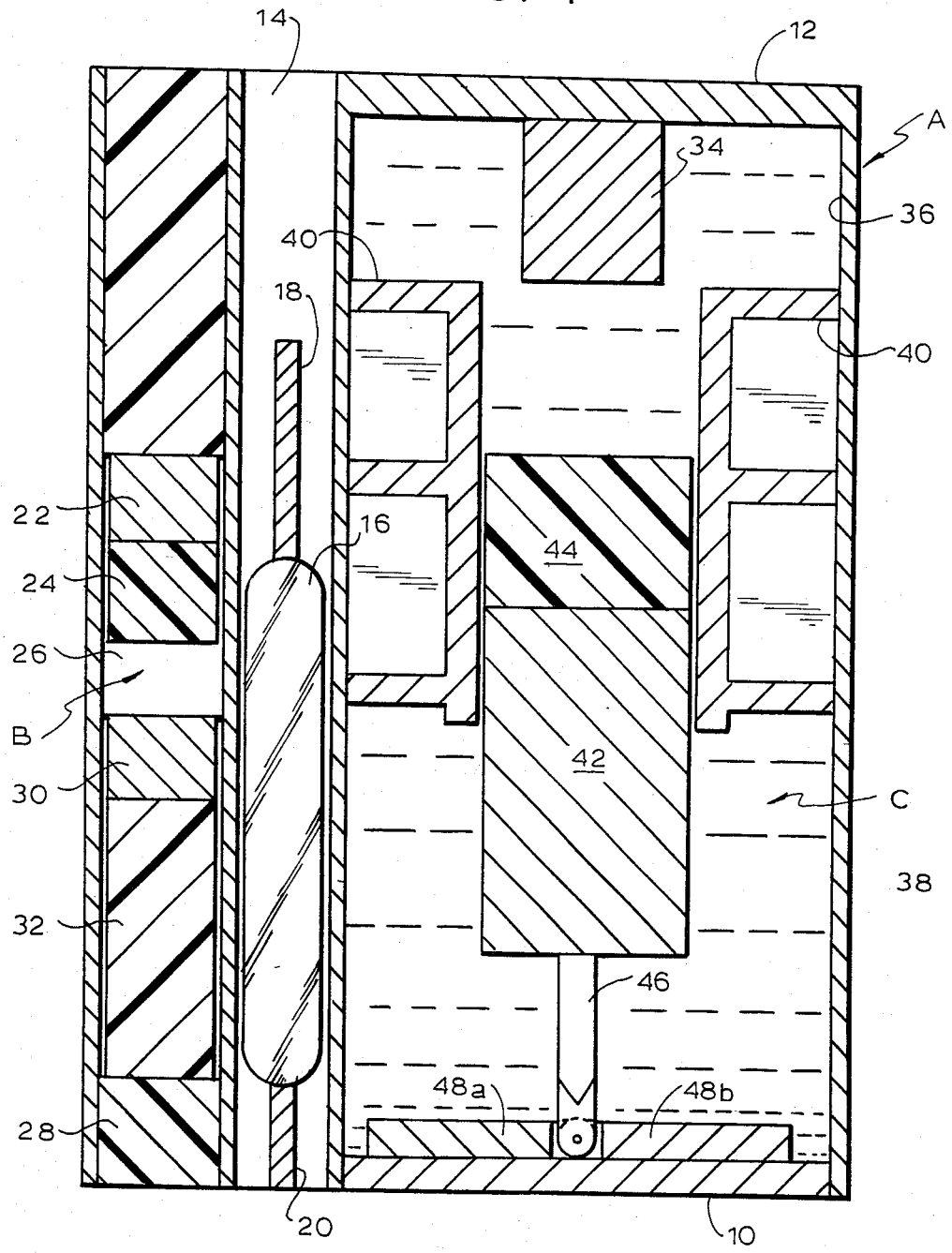
Figure 5:
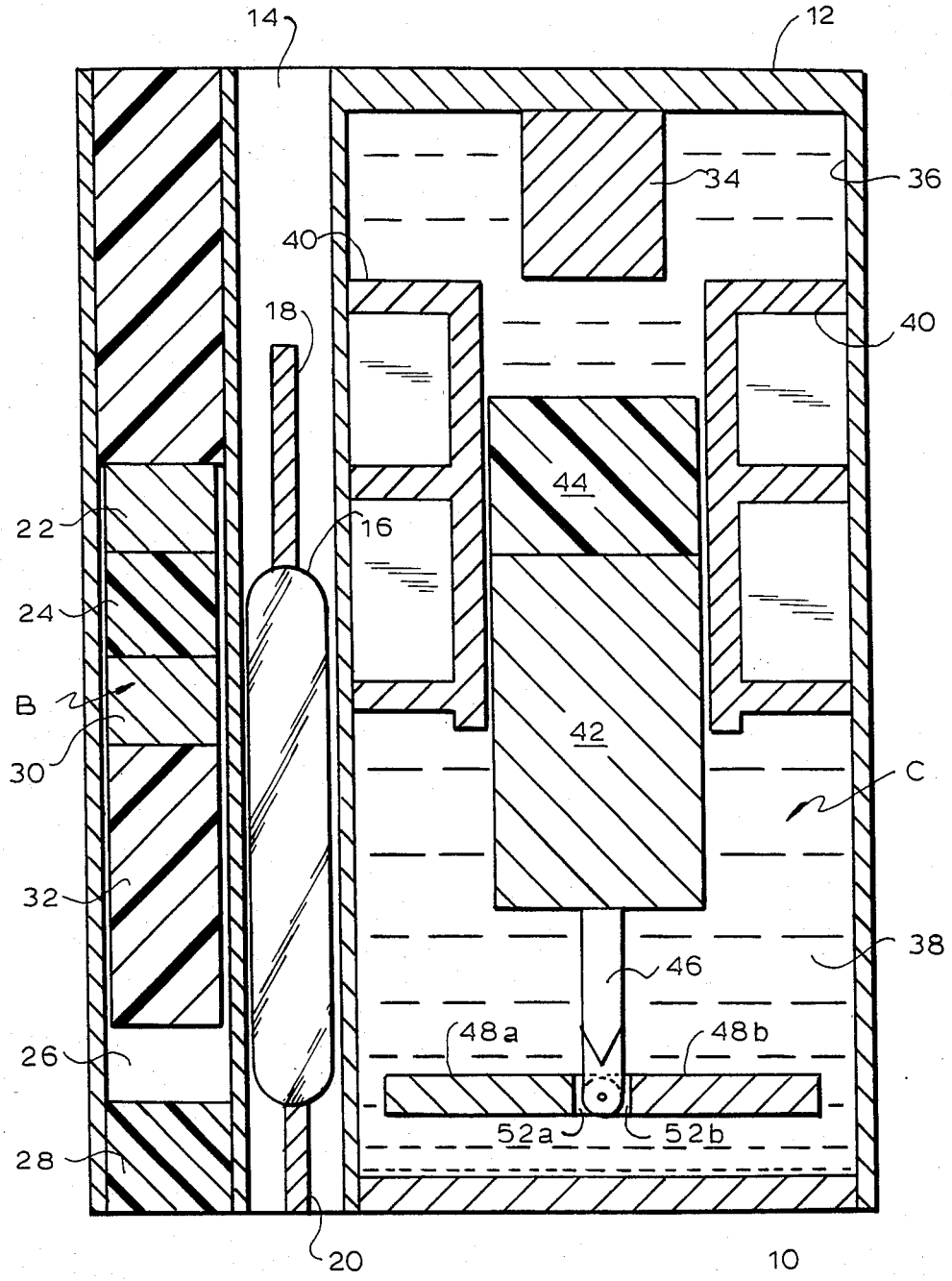

FIGS. 1 and 2 illustrate the switch of the present invention in its rest condition, that is, prior to the application of a significant deceleration force to the housing. FIGS. 3–5 illustrate the present invention at various times after the application of a significant deceleration force.

Magnet pairs 22, 30 and 34, 42 are selected such that the magnetic attraction forces between the magnets in each pair is smaller than the force which is produced when the object in which housing A is mounted decelerates in a lengthwise direction to a given degree. For example, the attractive force of the magnets can be selected such that it will be overcome by a force of 25 g., which corresponds to a deceleration of approximately 250 meters per second per second.

When the object in which housing A is mounted decelerates sufficiently rapidly, the two magnetic control systems B and C will respond. The rapidly reacting magnetic control system B responds immediately, for a short time period, whereas the relatively slowly reacting magnetic control system C responds for a relatively long time.

As soon as the lengthwise deceleration force exceeds the magnetic attractive forces between the magnetic pairs, the movable unit including magnet 30 moves away from fixed magnet 22 and towards end part 28 along recess 26. Mass 32, which is fixed to magnet 30, moves along with magnet 30. The change in position of the magnet 30 causes reed switch 16 to change from its initial state to a second state, that is, either from an actuated state to a deactuated state, or from a deactuated state to an actuated state. The forward movement of the unit including magnet 30 will cease once the forward surface of mass 32 abuts the rear surface of stop part 28 (as illustrated in FIG. 3).

In the meantime, the movable unit including magnet 42 and mass 44 has begun to move away from fixed magnet 34 and towards the forward facing end 10 of housing A, along recess 36. As this occurs, members 48*a* and 48*b* pivot to the position of least resistance to move through fluid 38, as illustrated in FIG. 3, such that each assumes an inclined position with respect to connecting element 46.

Members 48*a* and 48*b* will remain in this inclined position as the unit including magnet 42 travels forward along recess 36 and until the members abut the interior surface of the wall at the forward facing end 10 of the housing. At this point, members 48*a* and 48*b* pivot back to their original colinear positions, as illustrated in FIG. 4.

The movable units will remain in the positions illustrated in FIG. 4 until the applied force ceases, that is, its magnitude is reduced to a level below the attractive forces of the respective magnet pairs. At this point, the unit including magnet 30 rapidly returns to its original position proximate magnet 22. However, the unit including magnet 42 returns to its original position relatively slowly because of the resistance to movement in the return direction created by members 48*a* and 48*b*.

In their colinear positions, members 48*a* and 48*b* create the maximum resistance to the return movement of the unit including magnet 42 through fluid 38. Members 48*a* and 48*b* maintain their positions of maximum resistance as the unit including magnet 42 moves back towards fixed magnet 34, as illustrated in FIG. 5. In this position, members 48*a* and 48*b* cause the unit including magnet 42 to move towards magnet 34 relatively slowly, because of the relatively large resistance of fluid 38.

Although the unit including magnet 30 returns to its original position relatively rapidly after the application of sufficient deceleration force has terminated, reed switch 16 prevented from changing back to its original state by the influence of magnet 42. However, once magnet 42 returns to its original position, it will cause reed switch 16 to return to its initial state. Reed switch 16 has a hysteresis which prevents the switch from changing back to its original state even if magnet 32 has returned, or is returning, to its original position prior to significant movement of magnet 42. This prevents the reed switch 16 from returning to its initial state prior to the delay period, before the slow reacting magnetic control system C has sufficient opportunity to act to retain the switch in its changed state.

System B will react almost instantaneously to the application of a sufficient force and, consequently, will change the state of reed switch 16 from its initial state approximately 3 milliseconds or less after application of the force to housing A. Slow reacting system C, on the other hand, will not function to return reed switch 16 to its initial condition until a predetermined time interval, for example 50 milliseconds, after the operative deceleration force has terminated. The reed switch 16 will thus be held in its changed state for approximately 50 milliseconds after the original actuating force has disappeared.

The selection of a fluid 38 of particular viscosity and the size and shape of members 48*a* and 48*b* will determine the delay time after which reed switch 16 will return to its initial state. Thus, the delay time can be preset, within limits, through the appropriate selection of fluid and the structural design of members 48*a* and 48*b*.

It should now be appreciated that the present invention is a force responsive magnetic switch which is designed to be mounted on a moving object and to energize or de-energize an electrical circuit connected thereto upon the application of a sufficient deceleration force to the object. The invention includes a magnetically actuated switch, electrically connected to the circuit to be controlled and a pair of magnetic switch control systems. One of the control systems reacts relatively rapidly to the application of sufficient deceleration force and will change the state of the switch almost instantaneously. The second magnetic control system reacts much more slowly and will not return the switch to its initial state until the passage of a predetermined time interval after the force has terminated.

The speed of movement of the magnet in the second control system is regulated by a pair of pivotally mounted members, the position of which is determined by the direction of movement of the members through the fluid. The pivotally mounted members function to maximize the fluid resistance as the magnet connected thereto returns to the fixed magnet aligned therewith. As a consequence, the influence of the second magnetic control system on the reed switch, which results in the reed switch returning to its initial condition, is delayed for a predetermined time interval.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

I claim:

1. A force responsive switch comprising magnetically operated means switchable between first and second states and first and second magnetic means for controlling the state of said switchable means, said first magnetic control means reacting relatively rapidly to the application of a force above a given magnitude and being adapted to change the state of said switchable means from a first state to a second state, said second magnetic control means reacting relatively slowly to the application of force above said given magnitude and being adapted to change the state of said switchable means from said second state to said first stage a predetermined time interval after the application of the force above said given magnitude has terminated.

2. The switch of Claim 1, comprising a housing with a first recess and wherein said first magnetic control means comprises a magnet fixedly mounted to said housing proximate one end of said first recess and a magnet situated within said first recess and movable therein between a first position proximate said fixed magnet and a second position remote from said fixed magnet.

3. The switch of Claim 2, wherein said switchable means comprises a reed switch mounted in said housing proximate said first recess.

4. The switch of Claim 2, wherein said housing has a second recess and wherein said second magnetic control means comprises a second magnet fixedly mounted proximate one end of said second recess and a second movable magnet situated within said second recess and movable therein between a first position proximate said second fixed magnet and a second position remote from said second fixed magnet.

5. The switch of Claim 4, further comprising means associated with said second movable magnet and adapted to regulate the speed of movement of said second movable magnet along said second recess in accordance with the direction of movement thereof.

6. The switch of Claim 5, wherein said second recess contains a fluid and wherein said speed regulating means comprises mechanical means situated in said fluid for increasing the resistance of said fluid to the movement thereof in one direction as compared to the resistance of said fluid to the movement thereof in a second direction.

7. The switch of Claim 6, wherein said mechanical means comprises a member operably movably mounted to said second movable magnet, said member being movable between a first position wherein the fluid exerts relatively little resistance to the movement thereof and a second position wherein said fluid exerts a relatively large resistance to the movement thereof.

8. The switch of Claim 6, wherein said mechanical means comprises a connecting element mounted to said second movable magnet and first and second members pivotally mounted to one end of said connecting element.

9. A force responsive switch comprising magnetically operated means switchable between first and second states and first and second magnetic means for controlling the state of said switchable means, said first magnetic control means reacting to the application of a force above a given magnitude and being adapted to change the state of said switchable means from a first state to a second state, said second magnetic control means reacting to the application of force above said given magnitude and being adapted to change the state of said switchable means from said second state to said first state a predetermined time after the force above said given magnitude has terminated, said second magnetic control means comprising self-adjusting means for regulating the speed of reaction of said second magnetic control means.

10. The switch of Claim 9, wherein said second magnetic control means comprises a fluid containing recess and said regulating means comprises mechanical means movable within said recess, said mechanical means comprising means adapted to increase the resistance of the fluid to movement thereof in a first direction, as compared to the resistance of the fluid to movement thereof in a second direction.

11. The switch of Claim 9, wherein movement of said mechanical means in said second direction causes the state of said switchable means to change from said second state to said first state.

12. The switch of Claim 10, wherein said mechanical means comprises a member adapted to change position depending upon its direction of movement through said fluid.

13. A magnetic switch comprising a housing with first and second generally parallel spaced recesses elongated along the longitudinal axis of said housing, a pair of fixed magnets, each mounted in said housing proximate one end of a different one of said. recesses, respectively, a pair of magnets respectively situated within said first and second recesses and movable therein between first and second positions, said movable magnets normally being attracted toward said respective first positions, a reed switch mounted in said housing proximate said recesses and adapted to be operated bv the movement of said movable magnets and 1eans associated with one of said movable magnets for regulating the speed of movement thereof.

14. The switch of Claim 13, wherein said second recess contains a fluid and wherein said speed regulating means comprises a member situated in said second recess and operably movably mounted to said one movable magnet, said member being position adjustable so as to cause said fluid to resist the movement of said member therethrough to different degrees depending upon the direction of movement of said member through said fluid.

15. The switch of Claim 13, wherein movement of the other of said movable magnets causes said reed switch to change from its initial state and movement of said one movable magnet causes said reed switch to return to its original state.

16. The switch of Claim 14, wherein said speed regulating means causes the movement of said one movable magnet in one direction to be slower than the movement of said one movable magnet in a second direction so as to delay the change in state of said reed switch to its original state for a given time.

17. A force responsive switch comprising a housing, magnetically operated switch means mounted in said housing, magnetic means movably mounted in said housing proximate said switch means, said magnetic means being movable from a first position to a second position in response to the application of a force above a given magnitude to said housing and effective, when moved from said first position to said second position, to alter the state of said switch means from its original state, means, effective upon reduction of the applied force below said given magnitude, for moving said magnetic means from said second position towards said first position and means, operative on said switch means, for maintaining said switch means in said altered state for a given time interval after said magnetic means has moved from said second position and, thereafter, effective to return said switch means to its original state.

18. The force responsive switch of Claim 17, wherein said housing is adapted to be mounted in a movable object having an electrical circuit controlled by said switch means and further comprising means for operably electrically connecting said switch means with the electricial circuit.

19. A force responsive switch comprising a housing having a recess, magnetically operated switch means having movable, encapsulated contacts normally in a first spatial relationship defining a first state of said switch means, said switch means being mounted in said housing at a position electrically isolated and spaced from, but proximate to, said recess, magnetic means being movable from a first position to a second position within said recess in response to the application of a force above a given magnitude to said housing and effective, when moved from said first position towards said second position, to change the spatial relationship between said contacts to alter the state of said switch means from its first state to a second state, and magnetic return means, effective upon the reduction of the applied force below said given magnitude, for moving said magnetic means from said second position towards said first position.

20. The force responsive switch of Claim 17, further comprising means, operative on said switch means for maintaining said switch means in said second state for a given time interval after said magnetic means has moved from said second position and, thereafter, effective to return said switch means to said first state.

21. The force responsive switch of Claim 21, wherein said housing includes a second recess and wherein said state maintaining means comprises second magnetic means mounted within said second recess and movable therein in response to the force applied to said housing, said second magnetic means moving relatively slowly in one direction in response to the reduction of the applied force below said given magnitude.

22. The force responsive switch of Claim 19, wherein said housing is adapted to be mounted in a movable object having an electrical circuit controlled by said switch means and further comprising means for operably electrically connecting said switch means with the electrical circuit.

* * * * *